United States Patent [19]

Kochanowski

[11] 4,014,377

[45] Mar. 29, 1977

[54] STRUCTURE FOR SLIDABLE DOORS HAVING SNAP-MOUNTED GLIDE RETAINER

[75] Inventor: George A. Kochanowski, Lake Forest, Ill.

[73] Assignee: United States Gypsum Company, Chicago, Ill.

[22] Filed: Aug. 9, 1976

[21] Appl. No.: 712,618

[52] U.S. Cl. ..... 160/186; 160/196 R; 16/91

[51] Int. Cl.[2] ..... E05D 15/50

[58] Field of Search ..... 160/181, 186, 187, 196 R, 160/196 D, 206, 219, 237; 4/149, 153, 154; 16/87 R, 87.2, 87.4, 87.6, 87.8, 90, 91

[56] References Cited

UNITED STATES PATENTS

| | | | |
|---|---|---|---|
| 3,037,555 | 6/1962 | Kochanowski | 160/206 |
| 3,102,581 | 9/1963 | Kochanowski | 160/196 R |
| 3,169,574 | 2/1965 | Behlen | 160/196 R |
| 3,441,076 | 4/1969 | Glegf et al. | 160/196 R |

*Primary Examiner*—Peter M. Caun
*Attorney, Agent, or Firm*—Samuel Kurlandsky; Donnie Rudd; Robert H. Robinson

[57] ABSTRACT

A structure comprising a door panel having an elongated opening therein, and resilient mounting means on the panel engageable with a rail for moving the panel along the rail, the mounting means comprising a glide including a body disposed on one side of the panel, a roller rotatably mounted on the body engageable with the rail for movement of the glide thereon, a shank on the body extending through the panel opening and moveable therein for relative movement of the glide and the panel, detent flanges provided at both ends of the shank, and a C-shaped glide retainer mounted on the reverse side of the panel having flanges adapted to engage and clamp the detent flanges of the shank, and means for restraining the retainer against transverse movement.

19 Claims, 17 Drawing Figures

STRUCTURE FOR SLIDABLE DOORS HAVING SNAP-MOUNTED GLIDE RETAINER

BACKGROUND OF THE INVENTION

Field of Invention

The present invention relates to structures for resiliently mounting slidable doors on rails for movement thereon, and more particularly refers to a structure for suspending the doors on the rails without binding when the doors are moved, which structure may be relatively inexpensively fabricated and easily assembled and disassembled.

An important problem which is frequently encountered in the use of sliding doors is that of binding or sticking when the door is pulled or pushed out of its normal alignment. This problem is especially acute in the case of flexible doors, such as shower doors, which are more prone to misalignment. The slidable doors are also prone to leave their track or normal path of movement.

U.S. Pat. No. 3,102,581 discloses a slidable door having a spring-loaded roller for being engaged on a rail, resulting in a slidable door mounting structure which resists the tendency to bind and to be moved off the track when the door is handled in other than the desired manner, such as when it is grasped off-center with a resulting tendency to move the door out of alignment. However, this structure is somewhat expensive to fabricate and somewhat difficult to assemble and to affix to the door.

SUMMARY OF THE INVENTION

It is therefore an important object of the present invention to provide a mounting structure for slidable doors which prevents binding and holds the doors on their tracks.

It is a more particular object to provide a mounting structure which is adapted for use on flexible doors such as shower doors.

It is a more particular object to provide a mounting structure which yields to the forces producing misalignment of a door, thereby preventing binding, and which returns the door to its correct position when the forces are removed.

Another object is to provide a mounting structure which accommodates variations in spacing of the tracks on which the respective ends of slidable doors are mounted.

An additional object is to provide a mounting structure which is adapted for use with sheet or strip material door panels such as extruded metal panels.

A further object is to provide a mounting or suspending unit for doors which is readily and securely mounted thereon to suspend the doors from rails without binding or leaving the track.

Another particular object is to provide such a mounting unit which includes enclosed resilient means that cooperate in accomplishing the foregoing objects.

An additional object is to provide a mounting unit which is simple and economical yet efficient and durable, and which is substantially unaffected by temperature and humidity changes and corrosive tendencies.

These and other objects, advantages and functions of the invention will be apparent on reference to the specification and to the attached drawings illustrating preferred embodiments of the invention, in which like parts are identified by like reference symbols in each of the views.

DESCRIPTION OF THE PREFERRED EMBODIMENTS

Figure 1:
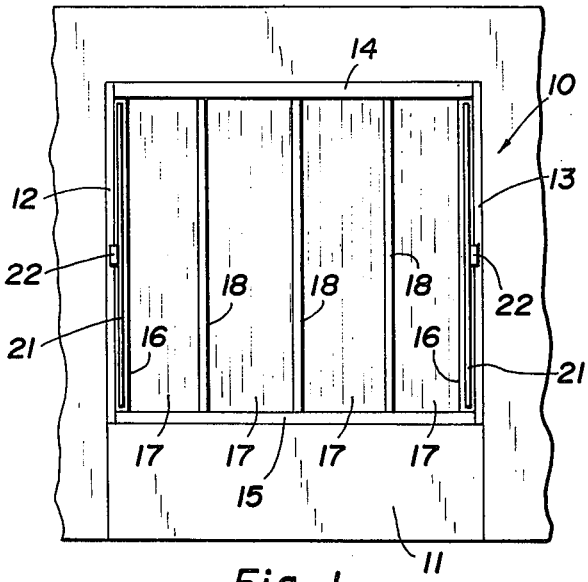
FIG. 1 is a front elevational view of a closed slidable shower door mounted on a bathtub.
Figure 2:
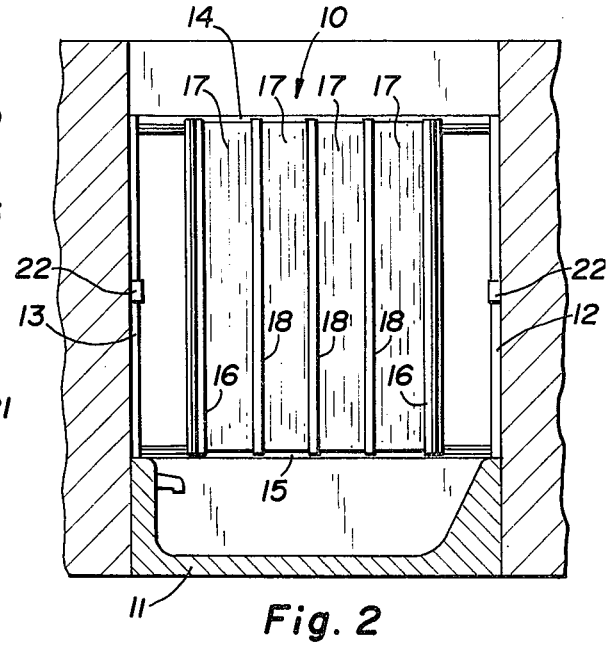
FIG. 2 is a rear elevational view thereof.
Figure 3:
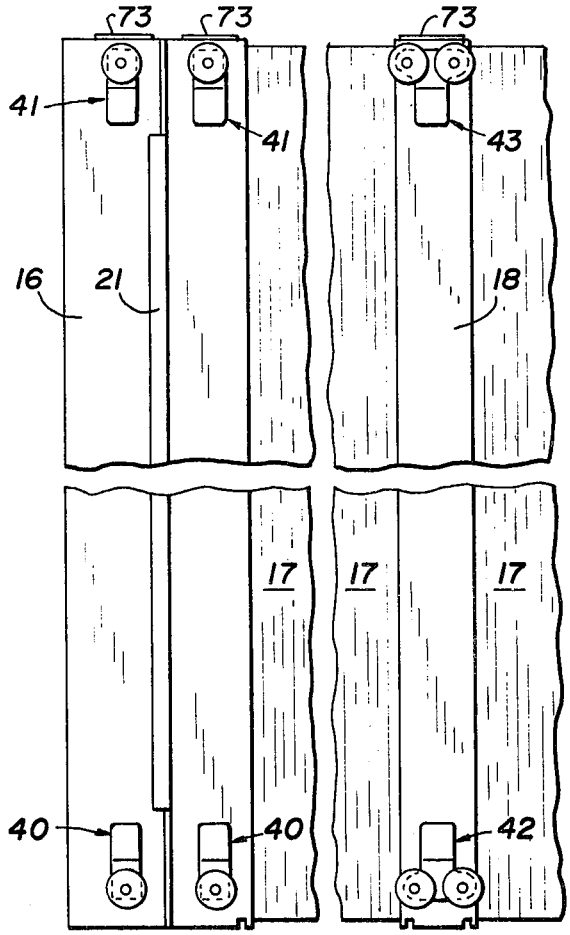
FIG. 3 is a broken front elevational view of a leading edge door panel or strip illustrating the new mounting structure at opposite ends thereof.
Figure 4:
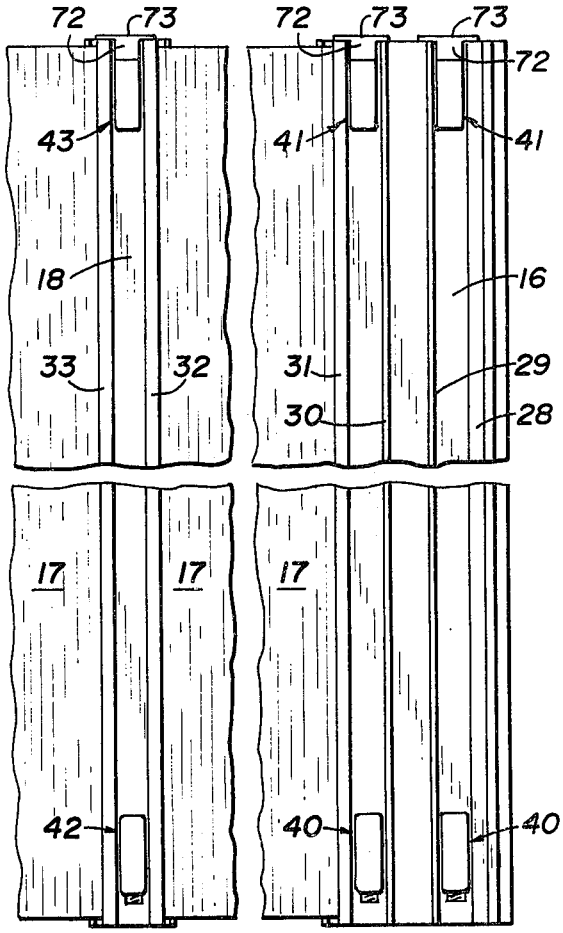
FIG. 4 is a broken rear elevational view thereof.
Figure 6:
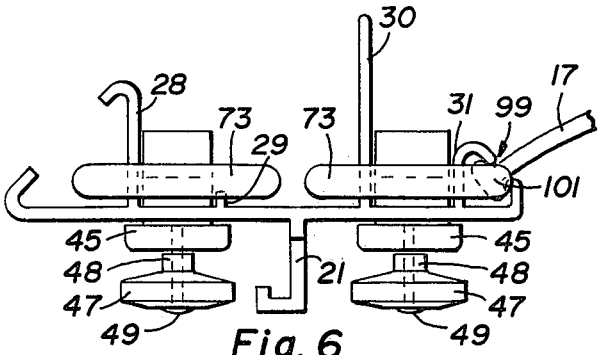
FIG. 6 is a plan view of the top of the structure of FIG. 5.

Referring to FIGS. 1 and 2 of the drawings, a shower door assembly is shown having the improved mounting structure of the invention. The assembly comprises a flexible slidable shower door 10 mounted on the outside of a bathtub 11 to form a closed compartment therewith. The door 10 is mounted in a frame or casing composed of upright frame members 12 and 13 on opposite sides of the door, and parallel upper and lower horizontal rails 14 and 15 at the upper and lower ends of the door. The door is constructed of alternate ridged and flexible vertically extending elongated panels, commencing at each end with a leading edge panel 16. A flexible panel 17 of plastic or other suitable material is joined to each leading edge panel 16 along one edge thereof. The opposite edge of the flexible panel is joined to a rigid divider panel 18. The divider panel 18 is in turn joined to another flexible panel 17 followed by another rigid divider panel 18. The door thus illustrated is constructed of two outer leading edge panels 16 and four flexible panels 17 alternating with three rigid divider panels 18 therebetween. A handle 21 is mounted on each leading edge panel, and a latch 22 is mounted on each of the uprights 12 and 13, for opening and closing the door 10 from either side.

Referring to FIGS. 3, 4, 5, 6, 7, 8 and 9, the rigid divider panels 18 are preferably constructed of relatively thin sheet or strip material which in the illustrative embodiments is extruded metal such as an aluminum alloy. The back side of the panel 16 is provided with pairs of spaced parallel longitudinal walls 28, 29, 30 and 31. Which extend laterally outwardly from the panel and provide channels therebetween. Walls 32 and 33 are provided on the rigid divider panel 18 for defining channels for restraining the flexible panels 17 of the present invention. A retaining groove 100 engages a bead 101 provided on the flexible panel 17.

The mounting structure of the invention includes lower glides 40 and upper glides 41 mounted on the leading edge panels 16, and lower glides 42 and upper glides 43 mounted on the rigid divider panels 18. The glides 40 and 41 as shown particularly in FIGS. 5, 7 and 11 have a generally rectangular body 45, an integral shank 46, and a roller 47. The glide body 45 is mounted for reciprocal sliding movement on the front surface of the leading edge panel 16. The shank 46 is rectangular and extends laterally outwardly from the glide body 45. The roller 47 includes an integral hub 48 which serves as a spacer to project the wheel portion of the roller forwardly from the body. The roller 47 is rotatably mounted on the body 45 by a rivet 49 extending through the hub. The glide body 45, the integral shank 46, and the roller 47 preferrably are constructed of a suitable plastic material such as acetal, Delrin or Celcon, the latter two being registered trademarks. Such construction is tough and resilient and has good bearing properties. The glide is resistant to the physical and chemical forces encountered including temperature and humidity conditions, frictional forces, and corrosive influences.

Figure 10:
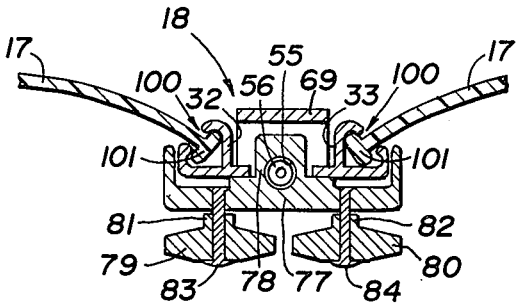
FIG. 10 is a cross-sectional view taken at the line 10 — 10 of FIG. 8.
Figure 11:
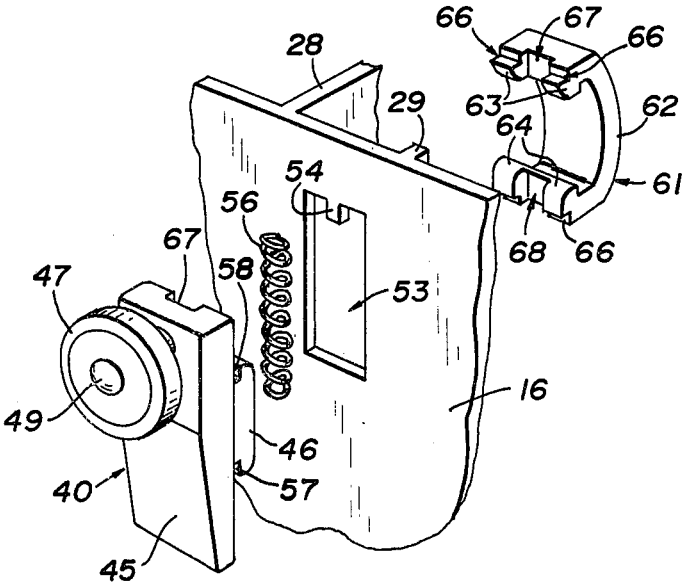
FIG. 11 is an exploded perspective view of one embodiment of the present invention.
Figure 12:
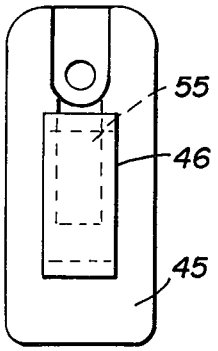
FIG. 12 is an elevational view of the insert member of the structure shown in FIG. 11.
Figure 13:
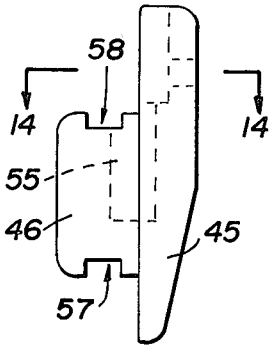
FIG. 13 is a side elevational view of the structure shown in FIG. 12.
Figure 14:
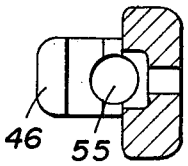
FIG. 14 is a top view partly in cross-section of the structure shown in FIGS. 12 and 13.

Referring to FIGS. 5–11, the glides 40 and 41 are mounted in the various panels 16 and 18 by providing a longitudinally extending rectangular slot 53 provided with a tab 54 at one end, as shown particularly in FIG. 11. The glides are mounted with the shanks of each extending through the rectangular slots 53 and being received loosely therein. A longitudinal bore 55 is provided in each shank. The bore is also formed partly in the adjoining glide body portion 45. The bore 55 receives one end of a coiled compression spring 56 therein, and the other end of the spring engages the tab 54 therearound and may abutt on the adjoining outer margin of the panel opening 53. The springs urge the glides 40–43 inwardly of the respective ends of the panel with the shanks normally seated on the ledges. From this position, each glide may be moved longitudinally outwardly against the force of the spring. The glide may move outwardly until its shank abutts on the outer margin of the panel opening, at which time the spring 56 is compressed, and the end of the tab 54 is received within the shank bore 55. The body 45 is provided with glide retainer grooves 57 and 58 at its ends.

The glides 40–43 are retained in place by means of glide retainers 61, each of which has an arched body member 62 with latching teeth 63 and 64 at its ends. Glide surfaces 65 are provided for slidably engaging the panel. Terminal recesses 66 are provided for permitting a screwdriver to be inserted therein for prying the glide retainers from the glides for removal of the glide assemblies. Spring-receiving recesses 67 and 68 are provided for receiving the springs and for preventing lateral movement of the glide retainers 61.

Figure 7:
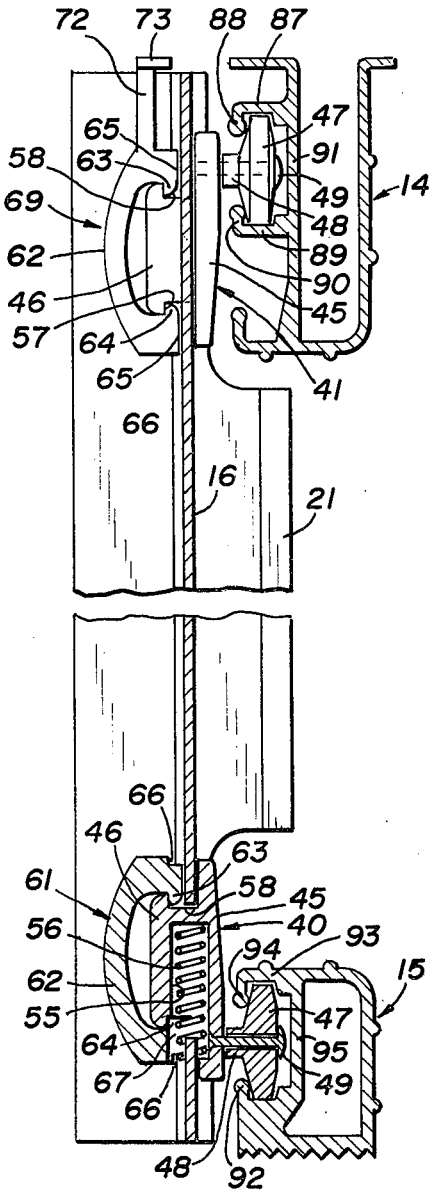
FIG. 7 is a cross-sectional view taken at the line 7 — 7 of FIG. 5, looking in the direction of the arrows.
Figure 5:
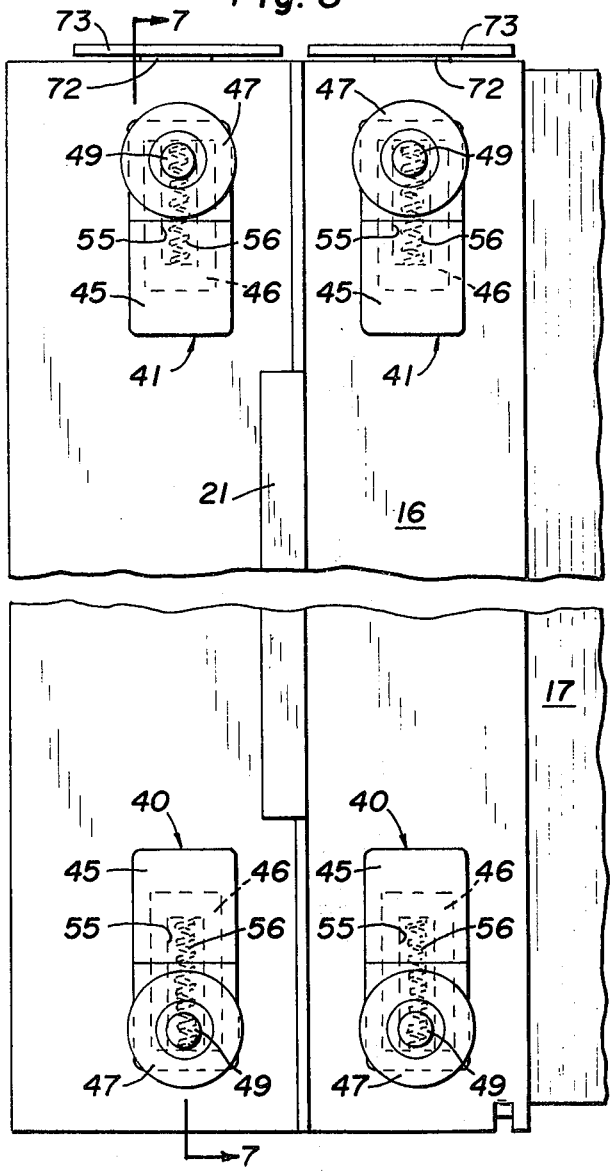
FIG. 5 is an enlarged fragmentary view of a portion of the structure of FIG. 3.

The embodiments of the glide retainers shown in the lower portions of FIGS. 5 and 7, and in 11 may be utilized for mounting glides both in the lower and upper margins of the shower doors. The shower door.

Figure 17:
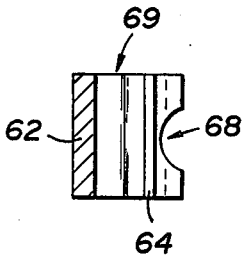
FIG. 17 is a cross-sectional view taken at line 17—17 of FIG. 16, looking in the directional of the arrows.
Figure 16:
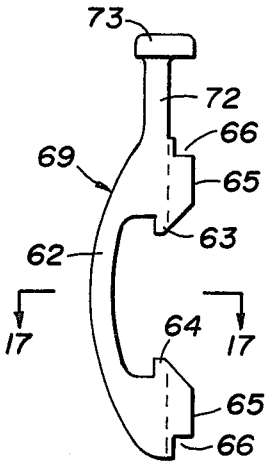
FIG. 16 is a side elevational view of the structure shown in FIG. 15.
Figure 15:
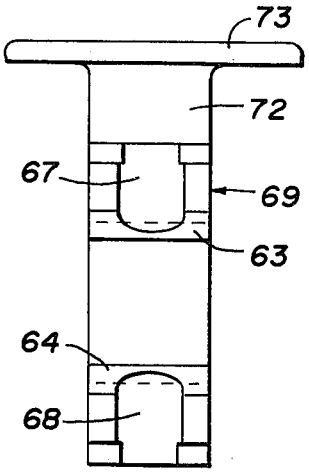
FIG. 15 is an elevational view of a retaining member of the invention.

In the upper portion of FIGS. 5 – 9 and in FIGS. 15 – 17, glide retainers are shown in an embodiment which is particularly suitable for mounting at either the upper margins or the lower margins of the shower door, since they facilitate the application and removal of the retainers.

In the embodiment shown, the glide 41 has a structure similar to that shown and described above. The glide retainer 69 also has a basic structure similar to that of the glide retainer 61. However, the retainer is additionally provided with a web or strap-form extension handle 72 provided with a transverse grip 73. The grip 73 may be engaged and the handle 72 moved to disengage the glide retainer 69 from the glide retainer grooves of the glide 41 and subsequently reengage the retainer without the use of an external tool. In contrast, in the embodiment shown in the lower portions of FIGS. 5, 7 and 11, it is necessary to insert the end of a tool such as a screwdriver into the terminal recesses 66 for disengaging the glide retainer.

Figure 8:
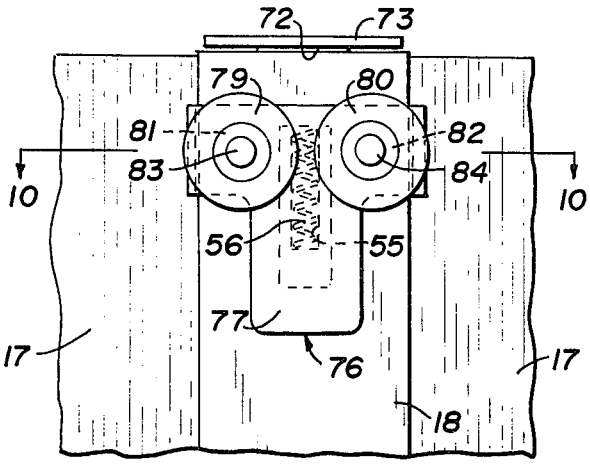
FIG. 8 is fragmentary elevational view of the double roller structure shown in FIGS. 3 and 4.
Figure 9:
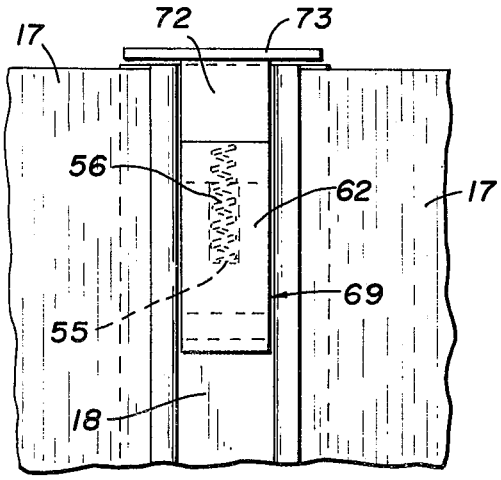
FIG. 9 is a rear elevational view of the structure shown in FIG. 8.

FIGS. 8–10 illustrate still another embodiment which is particularly useful for mounting on the rigid divider panel 18. The glide structure 76 comprises a generally rectangular body 77, integral shanks 78, a pair of rollers 79 and 80 mounted in tandem. The rollers have integral hubs 81 and 82 and are maintained in place by rivets 83 and 84. A glide retainer 69 similar to that shown in FIGS. 15–17 engages latching recesses provided in the shank, in a manner identical to that of the embodiments previously discussed. The glide structure having tandem rollers is especially adapted for suspending certain portions of the door panels between rails 14 and 15 (FIG. 7). The rails preferrably are formed of extruded corrosion-resistent metal and are adapted for holding the rollers on the respective tracks and preventing them from becoming dislodged. An outer or upper track 87 is formed within the top rail 14 and it is boarded by a guard flange 88. An inner or lower track 89 is provided parallel to the outer track and is boarded by a guard flange 90. The opposite sides of the tracks are closed by a rail wall 91. Similarly, adjoining guard flange 92, inner track 93, and adjoining flange 94 together with a closure wall 95 form the lower rail.

The glides 40-43 are tensioned or pulled into engagement with the rails 14 and 15 so that the glides and the panels are suspended therefrom. The rollers 47, 79 and 80 bear against the respective inner tracks 89 and 93, and the rollers roll along the tracks in opening and closing the sliding door 10.

The mounting structure of the invention provides a door mounting which is virtually trouble-free, notably in the case of flexible doors. Not only are the rollers prevented from being removed from the rails, but they are not bound or jammed when an off-center pulling or pushing force is exerted. When this happens the glides move outwardly against the springs, which absorb the forces that would otherwise tend to cause binding. When the leading edge panels are moved out of alignment, which is more often the case, the individually mounted glides at each end move individually according to the force at each point, preserving the two point suspension on the rollers. The rollers at each end of the panel continue to roll on the rail tracks. When the force is altered or released, the structure automatically rights itself. The invention provides the further advantage that variations of spacing between the top and bottom rails are accommodated by the resilient mounting, as are irregularities and possible foreign substances on the individual tracks.

The door panels with the mounting structure thereon present a very pleasing appearance when viewed from the front. The springs are enclosed by the glide body on the front and the retainer on the back, so that they are protected from fouling and are only visible from the rear. A particular advantage of the invention is that the glide retainers are easily prepared from plastic materials and easily engaged and disengaged with the detent structure of the shanks of the glides. The retaining structure is strong and does not fail even after extended periods of use. Further the plastic is not subject to corrosion or attack by atmospheric conditions.

It is to be understood that the invention is not to be limited to the exact details of operation or materials shown and described, as obvious modifications and equivalents will be apparent to one skilled in the art.

I claim:

1. A resiliently mountable panel structure for slidable doors comprising:

A. A door panel having an elongated opening therethrough,

B. Resilient mounting means on said panel and engageable with a rail for moving the panel on the rail comprising:

1. A glide comprising:
   a. A body disposed on one side of said panel,
   b. Projecting means on said body engageable with said rail for movement of said glide thereon, and
   c. A shank on said body extending through said panel opening and moveable therein for relative movement of said glide and said panel, said shank being provided at each end with latch-engaging means,
2. A glide retainer mounted on the reverse side of said panel comprising a generally C-shaped body and latching means at each end engaging the latch-engaging means of said shank and maintaining said glide in position on said panel, and
3. Resilient means interposed between said glide and said panel for tensioning said projecting means into engagement with said rail.

2. A panel structure according to claim 1, wherein said glide retainer body is arcuate and arranged to engage the latch-engaging means of said shank resiliently.

3. A panel structure according to claim 1, wherein the latch-engaging means at each end of said shank comprises a groove, and the latching means at each end of said glide retainer comprises a latching tooth engaging the grooves of said shank.

4. A panel structure according to claim 1, wherein the projecting means of said glide comprises a roller.

5. A panel structure according to claim 1, wherein said resilient means interposed between said glide and said panel comprises a compression spring mountable in said shank and engageable with said panel.

6. A panel structure according to claim 1, wherein said resilient mounting means engageable with a rail comprises a pair of tandem rollers.

7. A panel structure according to claim 1, wherein a notch is provided at least at one end of said glide retainer to permit removal of said retainer by inserting an instrument in said notch and applying prying force.

8. A panel structure according to claim 5, wherein a notch is provided in said glide retainer to clear said compression spring.

9. A panel structure according to claim 1, wherein longitudinal ridges are provided on said panel to restrain lateral movement of said glide retainer.

10. A panel structure according to claim 1, wherein both said glide and said glide retainer are formed of a plastic material.

11. A glide and retainer assembly for use in a resiliently mountable panel structure for slidable doors having panels, said glide being adapted to be mounted in an elongated opening provided in one of said panels and comprising:

a. a body adapted to be disposed on one side of said panel, b. projection means on said body engageable with a rail upon which said door panel is adapted to be mounted for movement of said glide thereon, and c. a shank on said body adapted to extend through said panel opening and to be moveable therein for relative movement of said glide and said panel, said shank being provided at each end with latch-engaging means, and said retainer being adapted to be mounted on the reverse side of said panel structure and to retain said glide thereon and comprising a generally C-shaped body having latching means at each end adapted to engage the latch-engaging means of said shank and to retain said glide in position on said panel thereby.

12. An assembly according to claim 11, wherein said glide retainer body is arcuate and arranged to engage the latch-engaging means of said shank resiliently.

13. An assembly according to claim 11, wherein the latch-engaging means at each end of said shank comprises a groove, and the latching means at each end of said glide retainer comprises a latching tool adapted to engage the grooves of said shank.

14. An assembly according to claim 11, wherein the projecting means of said glide comprises a roller.

15. An assembly according to claim 11, wherein said resilient mounting means engageable with a rail comprises a pair of tandem rollers.

16. An assembly according to claim 11, wherein a notch is provided at least at one end of said glide retainer to permit removal of said retainer by inserting an instrument in said notch and applying prying force.

17. An assembly according to claim 11, wherein both said glide and said glide retainer are formed of a plastic material.

18. A panel structure according to claim 1, wherein said glide retainer is provided with an integral extension at one end, said extension having a transverse grip at its end with ears extending beyond the sides of said extension, said extension and grip being adapted to be used as a handle to mount and dismount said retainer.

19. A glide and retainer assembly according to claim 11, wherein said retainer is provided with an integral extension at one end, said extension having a transverse grip at its end with ears extending beyond the sides of said extension, said extension and grip being adapted to be used as a handle to mount and dismount said retainer.

* * * * *